US006199971B1

(12) United States Patent
Sandberg et al.

(10) Patent No.: US 6,199,971 B1
(45) Date of Patent: Mar. 13, 2001

(54) DIRECT ELECTROSTATIC PRINTING METHOD AND APPARATUS WITH INCREASED PRINT SPEED

(75) Inventors: Agneta Sandberg, Göteborg; Bengt Bern, Mölndal, both of (SE)

(73) Assignee: Arrray Printers AB, Vastra Frolunda (SE)

( * ) Notice: Subject to any disclaimer, the term of this patent is extended or adjusted under 35 U.S.C. 154(b) by 0 days.

(21) Appl. No.: 09/028,629

(22) Filed: Feb. 24, 1998

(51) Int. Cl.[7] ..... B41J 2/06
(52) U.S. Cl. ..... 347/55
(58) Field of Search ..... 347/55, 120, 123, 347/111, 159, 141, 128, 17, 103, 154, 151, 327, 71, 352; 399/384, 327, 271, 290, 292, 293, 294, 295

(56) References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,320,408 | 3/1982 | Iwasa et al. . |
| 4,353,080 | 10/1982 | Cross . |
| 4,382,263 | 5/1983 | Fischbeck et al. . |

(List continued on next page.)

FOREIGN PATENT DOCUMENTS

| | | |
|---|---|---|
| 12 70 856 | 6/1968 | (DE) . |
| 26 53 048 | 5/1978 | (DE) . |
| 0323 143 A2 | 12/1988 | (EP) . |
| 0345 024 A2 | 6/1989 | (EP) . |
| 0352 997 A2 | 1/1990 | (EP) . |
| 0389 229 A2 | 3/1990 | (EP) . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet ® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—John Barlow
*Assistant Examiner*—Raquel Yvette Gordon
(74) *Attorney, Agent, or Firm*—Knobbe, Martens, Olson & Bear, LLP

(57) ABSTRACT

An image printing device and method for printing an image to an information carrier. The image printing device includes apertures which can be selectively opened or closed to permit or restrict the transport of pigment particles during print sequences, a predetermined number of which print sequences are included in a print cycle, to thereby enable the formation of a pigment image. Further, deflection electrodes are included for, by means of predetermined deflection voltages related to each one of the predetermined number of print sequences, controlling the deflection of pigment particles in transport to thereby be able to deflect pigment particles against predetermined locations in view of the image which is to be printed. To enable a faster print speed, according to the invention, the change of the predetermined deflection voltages of a previous print sequence to the predetermined deflection voltages of a current print sequence is time displaced relative to the beginning of the current print sequence.

24 Claims, 6 Drawing Sheets

U.S. PATENT DOCUMENTS

| | | |
|---|---|---|
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,727 | 6/1985 | Kohashi et al. . |
| 4,546,722 | 10/1985 | Toda et al. . |
| 4,571,601 | 2/1986 | Teshima . |
| 4,610,532 | 9/1986 | De Schamphelaere et al. . |
| 4,611,905 | 9/1986 | De Schamphelaere et al. . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,860,036 | 8/1989 | Schmidlin . |
| 4,903,050 | 2/1990 | Schmidlin . |
| 4,912,489 | 3/1990 | Schmidlin . |
| 5,028,812 | 7/1991 | Bartky . |
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,193,011 | 3/1993 | Dir et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,287,127 | 2/1994 | Salmon . |
| 5,305,026 | 4/1994 | Kazuo et al. . |
| 5,307,092 | 4/1994 | Larson . |
| 5,311,266 | 5/1994 | Madea . |
| 5,328,791 | 7/1994 | Ohta . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson . |
| 5,506,666 | 4/1996 | Masuda et al. . |
| 5,508,723 | 4/1996 | Maeda . |
| 5,515,084 | 5/1996 | Larson . |
| 5,523,827 | 6/1996 | Snelling et al. . |
| 5,526,029 | 6/1996 | Larson et al. . |
| 5,558,969 | 9/1996 | Uyttendaele et al. . |
| 5,559,586 | 9/1996 | Wada . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,729,817 * | 3/1998 | Raymond et al. . |
| 5,774,153 * | 6/1998 | Kuehnle et al. . |
| 5,774,159 | 6/1998 | Larson . |
| 5,801,729 | 9/1998 | Kitamura et al. . |
| 5,808,185 | 9/1998 | Kondo . |
| 5,818,480 | 10/1998 | Bern et al. . |
| 5,818,490 | 10/1998 | Larson . |
| 5,847,733 | 12/1998 | Bern . |
| 5,850,588 * | 12/1998 | Yoshikawa . |
| 5,867,191 | 2/1999 | Luque et al. . |
| 5,874,973 | 2/1999 | Wakahara . |
| 5,889,542 | 3/1999 | Albinsson . |
| 5,905,516 | 5/1999 | Kagayama . |
| 5,956,064 | 9/1999 | Sandberg . |
| 5,959,648 | 9/1999 | Albinsson . |
| 5,963,767 | 10/1999 | Habets et al. . |
| 5,966,152 | 10/1999 | Albinsson . |
| 5,971,526 | 10/1999 | Klockar . |

FOREIGN PATENT DOCUMENTS

| | | |
|---|---|---|
| 0377 208 A2 | 7/1990 | (EP) . |
| 0715 218 A1 | 11/1994 | (EP) . |
| 0660 201 A2 | 6/1995 | (EP) . |
| 0753 413 A1 | 7/1995 | (EP) . |
| 0703 080 A2 | 9/1995 | (EP) . |
| 0736 822 A1 | 3/1996 | (EP) . |
| 0795 792 A1 | 3/1996 | (EP) . |
| 072 072 A2 | 7/1996 | (EP) . |
| 0 743 572 A1 | 11/1996 | (EP) . |
| 0752 317 A1 | 1/1997 | (EP) . |
| 0764 540 A2 | 3/1997 | (EP) . |
| 0816 944 A1 | 4/1997 | (EP) . |
| 0844 095 A3 | 11/1997 | (EP) . |
| 2108432 | 5/1983 | (GB) . |
| 44-26333 | 11/1969 | (JP) . |
| 55-55878 | 4/1980 | (JP) . |
| 55-84671 | 6/1980 | (JP) . |
| 55-87563 | 7/1980 | (JP) . |
| 5689576 | 7/1981 | (JP) . |
| 58-044457 | 3/1983 | (JP) . |
| 58-155967 | 9/1983 | (JP) . |
| 62 248662 | 10/1987 | (JP) . |
| 62-13356 | 11/1987 | (JP) . |
| 01120354 | 5/1989 | (JP) . |
| 05220963 | 8/1990 | (JP) . |
| 04189554 | 8/1992 | (JP) . |
| 04 268591 | 9/1992 | (JP) . |
| 4282265 | 10/1992 | (JP) . |
| 05131671 | 5/1993 | (JP) . |
| 5208518 | 8/1993 | (JP) . |
| 7-186435 | 12/1993 | (JP) . |
| 93331532 | 12/1993 | (JP) . |
| 8-58143 | 8/1994 | (JP) . |
| 94200563 | 8/1994 | (JP) . |
| 06344587 | 12/1994 | (JP) . |
| 7246717 | 9/1995 | (JP) . |
| 9048151 | 2/1997 | (JP) . |
| 09118036 | 5/1997 | (JP) . |
| 9014960 | 12/1990 | (WO) . |

* cited by examiner

DIRECT ELECTROSTATIC PRINTING METHOD AND APPARATUS WITH INCREASED PRINT SPEED

FIELD OF THE INVENTION

The present invention relates to direct electrostatic printing methods in which charged toner particles are transported under control in accordance with an image information from a particle source to form a toner image used in a copier, a printer, a plotter, a facsimile, or the like.

BACKGROUND TO THE INVENTION

According to a direct electrostatic printing method, such as that disclosed in U.S. Pat. No. 5,036,341, a background electric field is produced between a developer sleeve and a back electrode to enable the transport of charged toner particles therebetween. A printhead structure, such as an electrode matrix provided with a plurality of selectable apertures, is interposed in the background electric field and connected to a control unit which converts an image information into a pattern of electrostatic control fields which selectively open or close the apertures, thereby permitting or restricting the transport of toner particles from the developer sleeve. The modulated stream of toner particles allowed to pass through opened apertures impinges upon an information carrier, such as paper, conveyed between the printhead structure and the back electrode, to form a visible image.

According to such a method, each single aperture is utilized to address a specific dot position of the image in a transverse direction, i.e. perpendicular to paper motion. Thus, the transversal print addressability is limited by the density of apertures through the printhead structure. For instance, a print addressability of 300 dpi requires a printhead structure having 300 apertures per inch in a transversal direction.

A new concept of direct electrostatic printing, hereinafter referred to as dot deflection control (DDC), was introduced in U.S. patent application Ser. No. 08/621,074. According to the DDC method each single aperture is used to address several dot positions on an information carrier by controlling not only the transport of toner particles through the aperture, but also their transport trajectory toward a paper, and thereby the location of the obtained dot. The DDC method increases the print addressability without requiring a larger number of apertures in the printhead structure. This is achieved by providing the printhead structure with at least two sets of deflection electrodes connected to variable deflection voltages which, during each print cycle, sequentially modify the symmetry of the electrostatic control fields to deflect the modulated stream of toner particles in predetermined deflection directions.

For instance, a DDC method performing three deflection steps per print cycle, provides a print addressability of 600 dpi utilizing a printhead structure having 200 apertures per inch.

An improved DDC method, disclosed in U.S. patent application Ser. No. 08/759,481, provides a simultaneous dot size and dot position control. This later method utilizes the deflection electrodes to influence the convergence of the modulated stream of toner particles thus controlling the dot size. According to the method, each aperture is surrounded by two deflection electrodes connected to a respective deflection voltage D1, D2, such that the electrode field generated by the control electrodes remains substantially symmetrical as long as both deflection voltages D1, D2 have the same amplitude. The amplitudes of D1 and D2 are modulated to apply converging forces on toner to obtain smaller dots. The dot position is simultaneously controlled by modulating the amplitude difference between D1 and D2. Utilizing this improved method enables 60 $\mu$m dots to be obtained utilizing 160 $\mu$m apertures.

With DDC, in direct electrostatic printing methods, there appears so called dot tailing when the upper limit of the print speed is attained. This is due to insufficient deflection of the last toner particles of a dot. It can thus be considered a drawback of current direct electrostatic printing methods that there is at least to a certain extent a tradeoff between print speed and image quality. Therefore, there seems to still exist a need to improve the current direct electrostatic printing method.

SUMMARY OF THE INVENTION

An object of the present invention is to provide a method of and device for increasing the print speed of direct electrostatic printing methods.

A further object of the present invention is to provide a method of direct electrostatic printing which increases the print speed without a degradation in print quality.

Still a further object of the present invention is to provide a method of and a device for improving control over dot placement in direct electrostatic printing methods.

Yet a further object of the present invention is to provide a method of and a device for enhancing dot sharpness in direct electrostatic printing methods.

Another object of the present invention is to provide a method of and device for reducing or eliminating dot tailing in direct electrostatic printing methods.

Still another object of the present invention is to provide a method of and a device for trajecting toner particles to predetermined positions in view of an image which is to be printed.

Said objects are achieved according to the invention by providing an image printing device and method for printing an image to an information carrier. The image printing device includes apertures which can be selectively opened or closed to permit or restrict the transport of pigment particles during print sequences, a predetermined number of which print sequences are included in a print cycle, to thereby enable the formation of a pigment image. Further, deflection electrodes are included for, by means of predetermined deflection voltages related to each one of the predetermined number of print sequences, controlling the deflection of pigment particles in transport to thereby be able to deflect pigment particles against predetermined locations in view of the image which is to be printed. To enable a faster print speed, according to the invention, the change of the predetermined deflection voltages of a previous print sequence to the predetermined deflection voltages of a current print sequence is time displaced relative to the beginning of the current print sequence.

Said objects are also achieved according to the invention by an image printing device and method for printing an image onto an information carrier. The direct electrostatic printing device includes a pigment particle source, a voltage source, a printhead structure, a control unit, and an image receiving member. The pigment particle source provides pigment particles. The image receiving member and the printhead structure move relative to each other during printing. The image receiving member has a first face and a second face. The printhead structure is placed inbetween the pigment particle source and the first face of the image receiving member. The voltage source is connected to the pigment particle source and the back electrode to thereby create an electrical field for transport of pigment particles from the pigment particle source toward the first face of the image receiving member. The printhead structure includes control electrodes connected to the control unit to thereby selectively open or close apertures through the printhead structure to permit or restrict the transport of pigment particles during print sequences, a predetermined number of which print sequences are included in a print cycle, to thereby enable the formation of a pigment image on the first face of the image receiving member. According to the invention the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences. And also according to the invention the change of the predetermined deflection voltages of a previous print sequence to the predetermined deflection voltages of a current print sequence is time displaced relative to the beginning of the current print sequence, to thereby enable a faster print speed.

Advantageously the time displacement of the change of the predetermined deflection voltages of a previous print sequence to the predetermined deflection voltages of a current print sequence is a time delay which is greater than zero.

The value of the time displacement can, depending on the specific application and for example the type of pigment particles/toner, vary. It can for example be less than the time of transport of a pigment particle from the pigment particle source to the printhead structure, in the order of magnitude of the time of transport of a pigment particle from the pigment particle source to the printhead structure, in the order of magnitude of the time of transport of a pigment particle from the pigment particle source to halfway through an aperture, or in the order of magnitude of the time of transport of a pigment particle from the pigment particle source to just through an aperture. In current preferred embodiments the time displacement is in the region of 0.1 $\mu$S to 100 $\mu$S and preferably within the region of 10 $\mu$S to 50 $\mu$S.

Advantageously the change of the predetermined deflection voltages of a previous print sequence to the predetermined deflection voltages of a current print sequence is time displaced relative to the beginning of the current print sequence in such a way that the change of the deflection voltages do not coincide with respect to time with a possible time for opening an aperture during the current print sequence.

In some embodiments the image printing device comprises an image receiving member position measuring means for measuring the position of the image receiving member in relation to the apertures to thereby via the control unit be able to synchronize the selective opening and closing of the-apertures through the printhead structure according to the relative movement of the printhead structure and the image receiving member to thereby enable the formation of a pigment image at a predetermined position on the image receiving member in view of the image which is to be printed. Advantageously the image printing device includes at least two pigment particle sources with their respective corresponding control electrodes and apertures, whereby the image receiving member position measuring means measures the position of the image receiving means in relation to the respective apertures to thereby via the control unit be able to synchronize the selective openeing and closing of the respective apertures through the at least one printhead structure according to the relative movement of the at least one printhead structure and the image receiving member to thereby enable the formation of a respective pigment image at a predetermined position on the image receiving member in view of the image which is to be printed. In certain embodiments the image printing device is capable of printing color images and includes four pigment particle sources.

In certain embodiments the image receiving member is an information carrier such as paper or the like. In other embodiments the image receiving member is an intermediate image receiving member and includes a transfer belt positioned at a predetermined distance from the printhead structure, the transfer belt being substantially of uniform thickness, whereby the pigment image is subsequently transferred to an information carrier. Advantageously the transfer belt is supported by at least one holding element arranged on the side of the second face of the transfer belt adjacent to the print station. Also advantageously the first face of the intermediate image receiving member is substantially evenly coated with a layer of bouncing reduction agent thus providing a surface on the first face of the intermediate image receiving member that the pigment particles transported through the print head structure substantially adhere to substantially without bouncing. The bouncing reduction agent can preferably be a liquid having adhesion properties suitable for the adhesion of pigment particles to the first face of the intermediate image receiving member and wherein the image printing device further comprise a film application means for applying the bouncing reduction agent liquid substantially evenly as a film layer onto the first face of the intermediate image receiving member. Advantageously the bouncing reduction agent is a silicone oil having appropriate adhesion properties for reducing bouncing of pigment particles when pigment particles are transferred onto the first face of the intermediate image receiving means and also having appropriate release properties when a pigment image is transferred to an information carrier from the intermediate image receiving member. In some of these embodiments the image printing device further comprises a transfuser having heating means and pressurising means for transferring a pigment image on the surface of the first face of the intermediate image receiving member to an information carrier by locally applying heat and pressure to the information carrier and the pigment image by the heating means and pressurising means and thereby transferring the pigment image to the information carrier. In some of these embodiments the image printing device comprises a pressure changing means which can create a pressure difference on the side of the second face of the intermediate image receiving member in the vicinity of the apertures of the printhead structure, and where the intermediate image receiving member comprises a cleaning area for cleaning purposes and a separate image area intended for reception of pigment particles for formation of a pigment image thereon, where the cleaning area includes at least one slot between the first face and the second face intended for transmitting the pressure difference through the intermediate image receiving member to thereby, in cooperation with the pressure changing means in the vicinity of the apertures of the printhead structure, dislodge pigment agglomeration for cleaning the apertures of the printhead structure.

In certain embodiments the printing device includes at least two pigment particle sources with corresponding control electrodes and apertures on and in at least one printhead structure.

In other embodiments the image printing device includes four pigment particle sources with corresponding control electrodes and apertures on and in at least one printhead structure.

Advantageously the image printing device further comprises deflection control feedback means for providing a deflection feedback signal to the control unit to thereby control the deflection electrodes in such a way that pigment particles are, for formation of a pigment image on the intermediate image receiving member in view of the image which is to be printed, trajected toward predetermined locations on the intermediate image receiving member.

Said objects are also achieved according to the invention by a method for printing an image to an image receiving member such as an information carrier. The method comprises a number of steps. In a first step pigment particles are provided from a pigment particle source. according to a second step an image receiving member and a printhead structure move relative to each other during printing. In a third step an electrical field is created for transporting of pigment particles from the pigment particle source toward a first face of the image receiving member via the printhead structure. In a fourth step for enabling the formation of a pigment image on the first face of the image receiving member during a print sequence, a predetermined number of which print sequences are included in a print cycle, selectively opening or closing apertures through the printhead structure to permit or restrict the transporting of pigment particles. In a fifth step controlling the deflection of pigment particles in transport to thereby be able to deflect pigment particles against predetermined locations on the first face of the image receiving member in view of the image which is to be printed by means of predetermined deflection voltages related to each one of the predetermined number of print sequences. And finally in a sixth step, the change of the predetermined deflection voltages of a previous print sequence to the predetermined deflection voltages of a current print sequence is time displaced relative to the beginning of the current print sequence to thereby enable a faster print speed.

Further variations of the method according to previously described enhancements are possible in view of the application of the invention.

The present invention satisfies a need for increased print speed and increased accuracy of dot deflection control in direct electrostatic printing methods and apparatus by providing a time displacement, a time delay, of the change of deflection voltages from one print sequence to another. The present invention also relates to a direct printing method performed in consecutive print cycles, each of which includes several print sequences having specific deflection modes. During each print sequence, control voltages are applied to control electrodes to produce electrostatic control fields which, due to control in accordance with the image information, open or close apertures through the printhead structure, thus enhancing or inhibiting the transport of toner particles from the particle source toward an image receiving member, such as an information carrier or intermediate image receiving member in the form of a transfer belt. Deflection voltages are applied time displaced to the deflection electrodes to influence the symmetry of the electrostatic control fields to deflect the transported toner particles in predetermined directions, such that several dot locations are addressable through each aperture during each print cycle. The deflection length, i.e. the distance between a deflected dot and a central axis of the corresponding aperture, is optimized to obtain uniformly spaced dot locations across the entire width of the intermediate image receiving member.

Other objects, features and advantages of the present inventions will became more apparent from the following description when read in conjunction with the accompanying drawings in which preferred embodiments of the invention are shown by way of illustrative examples.

BRIEF DESCRIPTION OF THE DRAWINGS

The invention will now be described in more detail for explanatory, and in no sense limiting, purposes, with reference to the following drawings, wherein like reference numerals designate like parts throughout and where the dimensions in the drawings are not to scale, in which.

DESCRIPTION OF PREFERRED EMBODIMENTS

In order to clarify the method and device according to the invention, some examples of its use will now be described in connection with FIGS. 1 to 7.

Figure 1:
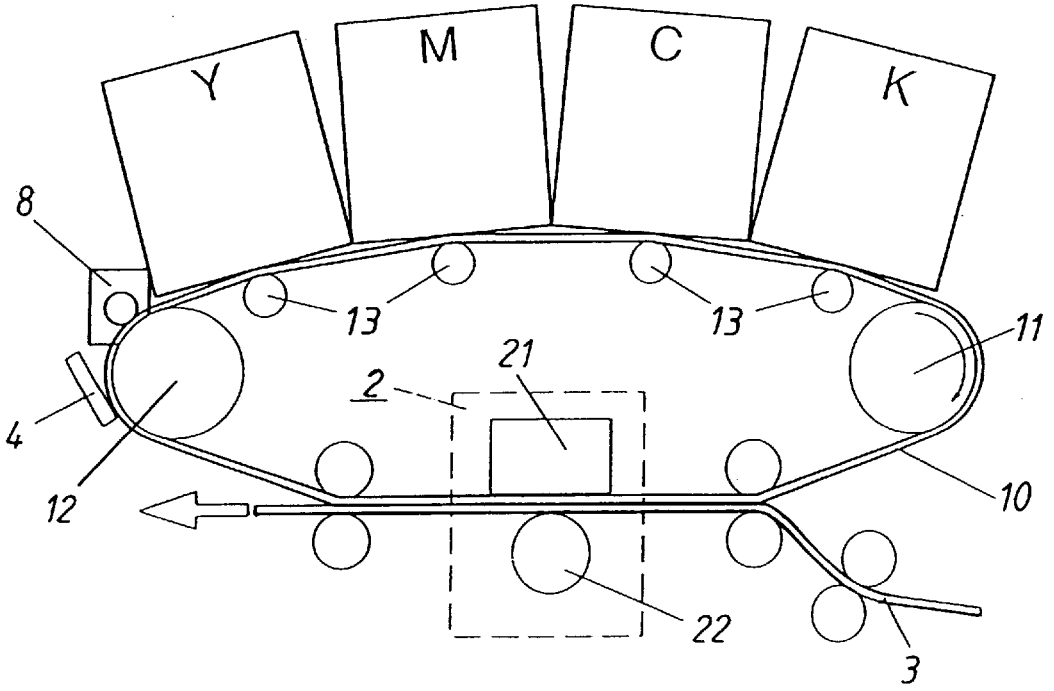
FIG. 1 is a schematic section view across an image printing apparatus according to a preferred embodiment of the invention.

FIG. 1 is a schematic section view of an image printing apparatus according to a first embodiment of the invention, comprising at least one print station, preferably four print stations stations (each corresponding to a pigment colour, e.g. yellow, magenta, cyan, black (Y, M, C, K)) an intermediate image receiving member, a driving roller 11, at least one support roller 12, and preferably several adjustable holding elements 13. The four print stations (Y, M, C, K) are arranged in relation to the intermediate image receiving member. The intermediate image receiving member, preferably a transfer belt 10, is mounted over the driving roller 11. In other embodiments according to the invention a transfer belt is only used to transport the information carrier. The at least one support roller 12 is provided with a mechanism for maintaining the transfer belt 10 with at least a constant surface tension, while preventing transversal movement of the transfer belt 10. The preferably several adjustable holding elements 13 are for accurately positioning the transfer belt 10 at least with respect to each print station.

The driving roller 11 is preferably a cylindrical metallic sleeve having a rotational axis extending perpendicular to the belt motion and a rotation velocity adjusted to convey the transfer belt 10 at a velocity of one addressable dot location per print cycle, to provide line by line scan printing. The adjustable holding elements 13 are arranged for maintaining the surface of the transfer belt 10 at a predetermined distance from each print station. The holding elements 13 are preferably cylindrical sleeves disposed perpendicularly to the belt motion in an arcuated configuration for slightly bending the transfer belt 10 at least in the vicinity of each print station. The transfer belt 10 is slightly bent in order to, in combination with the belt tension, create a stabilization force component on the transfer belt 10. The stabilization force component is opposite in direction and preferably larger in magnitude than an electrostatic attraction force component acting on the transfer belt 10. The electrostatic attraction forces at a print station are created by different electric potentials on the transfer belt 10 and on the print station in question.

The transfer belt 10 is preferably an endless band of 30 to 200 $\mu$m thick composite material as a base. The base composite material can suitably include thermoplastic polyamide resin or any other suitable material having a high thermal resistance, such as 260° C. of glass transition point and 388° C. of melting point, and stable mechanical properties under temperatures in the order of 250° C. The composite material of the tranfer belt 10 preferably has a homogeneous concentration of filler material, such as carbon or the like, which provides a uniform electrical conductivity throughout the entire surface of the transfer belt 10. The outer surface of the transfer belt 10 is preferably overlaid with a 5 to 30 $\mu$m thick coating layer made of electrically conductive polymere material such as for instance PTFE (poly tethra fluoro ethylene), PFA (tetra flouro ethylene, perflouro alkyl vinyl ether copolymer), FEP (tetra flouro ethylene hexaflouro, propylene copolymer), silicone, or any other suitable material having appropriate conductivity, thermal resistance, adhesion properties, release properties, and surface smoothness. To further improve for example the adhesion and release properties a layer of silicone oil can be applied to either the transfer belt base or preferably onto a coating layer if it is applied onto the transfer belt base. The silicone oil is coated evenly onto the transfer belt 10 preferably in the order of 0.1 to 2 $\mu$m thick giving a consumption of silicone oil in the region of 1 centiliter for every 1000 pages. Silicone oil also reduces bouncing/-scattering of toner particles upon reception of toner particles and also increases the subsequent transfer of toner particles to an information carrier. Making use of silicone oil and especially coating of the transfer belt with silicone oil is made possible in an electrostatic printing method according to the present invention as there is no direct physical contact between a toner delivery and a toner recipient, i.e. the transfer belt, in this embodiment.

In some embodiments the transfer belt 10 can comprise at least one separate image area and at least one of a cleaning area and/or a test area. The image area being intended for the deposition of toner particles, the cleaning area being intended for enabling the removal of unwanted toner particles from around each of the print stations, and the test area being intended for receiving test patterns of toner particles for calibration purposes. The transfer belt 10 can also in certain embodiments comprise a special registration area for use of determining the position of the transfer belt, especially an image area if available, in relation to each print station. If the transfer belt comprises a special registration area then this area is preferably at least spatially related to an image area.

The transfer belt 10 is conveyed past the four different print stations (Y, M, C, K), i.e. the transfer belt 10 and the print stations move in relation to each other, whereby toner particles are deposited on the outer surface of the transfer belt 10 and superposed to form a toner image. Toner images are then preferably conveyed through a fuser unit 2, comprising a fixing holder 21 arranged transversally in direct contact with the inner surface of the transfer belt. In some embodiments of the invention the fuser unit is separated from the transfer belt 10 and only acts on an information carrier. The fixing holder 21 includes a heating element preferably of a resistance type of e.g. molybdenium, maintained in contact with the inner surface of the transfer belt 10. As an electric current is passed through the heating element, the fixing holder 21 reaches a temperature required for melting the toner particles deposited on the outer surface of the transfer belt 10. The fuser unit 2 further comprises a pressing roller 22 arranged transversally across the width of the transfer belt 10 and facing the fixing holder 21. An information carrier 3, such as a sheet of plain, untreated paper or any other medium suitable for direct printing, is fed from a paper delivery unit (not shown) and conveyed between the pressing roller 22 and the transfer belt 10. The pressing roller 22 rotates with applied pressure to the heated surface of the fixing holder 21 whereby the melted toner particles are fused on the information carrier 3 to form a permanent image. After passage through the fusing unit 2, the transfer belt is brought in contact with a cleaning element 4, such as for example a replaceable scraper blade of fibrous material extending across the width of the transfer belt 10 for removing all untransferred toner particles. If the transfer belt 10 is to be coated with silicone oil or the like, then preferably after the cleaning element 4, and before the printing stations, the transfer belt 10 is brought into contact with a coating application element 8 for evenly coating the transfer belt with silicone oil or the like. In other embodiments toner particles are deposited directly onto an information carrier without first being deposited onto an intermediate image receiving member.

Figure 2:
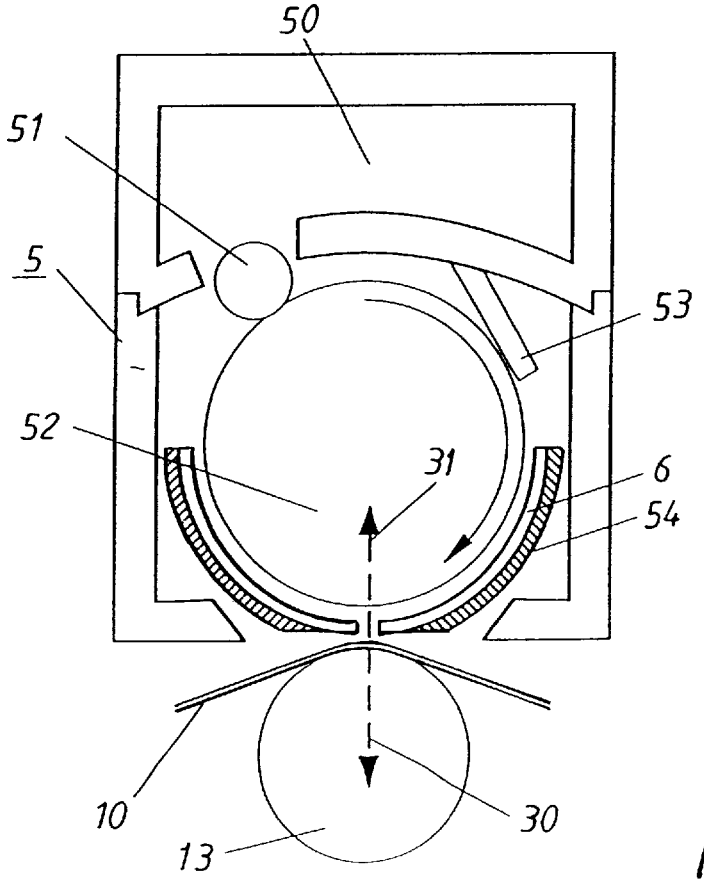
FIG. 2 is a schematic section view across a particular print station of the image printing apparatus shown in FIG. 1.

FIG. 2 is a schematic section view of one embodiment of a print station in, for example, the image printing apparatus shown in FIG. 1. A print station includes a particle delivery unit 5 preferably having a replaceable or refillable container 50 for holding toner particles, the container 50 having front and back walls, a pair of side walls and a bottom wall having an elongated opening extending from the front wall to the back wall and provided with a toner feeding element (not shown) disposed to continuously supply toner particles to a developer sleeve 52 through a particle charging member. The particle charging member is preferably formed of a supply brush 51 or a roller made of or coated with a fibrous, resilient material. The supply brush 51 can, for example, be brought into mechanical contact with the peripheral surface of, for example, the developer sleeve 52, for charging particles by contact charge exchange due to triboelectrification of the toner particles through frictional interaction between the fibrous material on the supply brush 51 and any suitable coating material of, for example, the developer sleeve 52. The developer sleeve 52 can preferably be made of metal and optionally coated with a conductive material, and preferably has a substantially cylindrical shape and a rotation axis extending parallel to the elongated opening of the particle container 50. Charged toner particles are held to the surface of the developer sleeve 52 by electrostatic forces essentially proportional to $(Q/D)^2$, where Q is the particle charge and D is the distance between the particle charge center and the boundary of the developer sleeve 52. Alternatively, the charging unit may additionally comprise a charging voltage source (not shown), which supply an electric field to induce or inject charge to the toner particles. Although it is preferred to charge particles through contact charge exchange, the method can be performed by using any other suitable charge unit, such as a conventional charge injection unit, a charge induction unit or a corona charging unit, without departing from the scope of the present invention.

A metering element 53 is positioned proximate to the developer sleeve 52 to, for example, adjust the concentration of toner particles on the peripheral surface of the developer sleeve 52, to form a relatively thin, uniform particle layer thereon. In certain embodiments the metering element 53 also provides a function of charging toner particles. The metering element 53 may be formed of a flexible or rigid, insulating or metallic blade, roller or any other member suitable for providing a uniform particle layer thickness. The metering element 53 may also be connected to a metering voltage source (not shown) which influence the triboelectrification of the particle layer to ensure a uniform particle charge distribution and mass density on the surface of the developer sleeve 52.

The developer sleeve 52 is arranged in relation with a support device 54 for supporting and maintaining the printhead structure 6 in a predetermined position with respect to the peripheral surface of the developer sleeve 52. The support device 54 is preferably in the form of a trough-shaped frame having two side walls, a bottom portion between the side walls, and an elongated slot arranged through the bottom portion, extending transversally across the print station, parallel to the rotation axis of the developer sleeve 52. The support device 54 further comprises means for maintaining the printhead structure in contact with the bottom portion of the support device 54, the printhead structure 6 thereby bridging the elongated slot in the bottom portion.

The transfer belt 10 is preferably slightly bent partly around each holding element 13 in order to create a stabilization force component 30. The stabilization force component 30 is intended to counteract, among other things, a field force component 31 which is acting on the transfer belt. If the field force component 31 or, for example, mechanical irregularities are not counteracted they can cause distance fluctuations between the transfer belt 10 and the printhead structure 6 which can cause a degradation in print quality.

Figure 3:
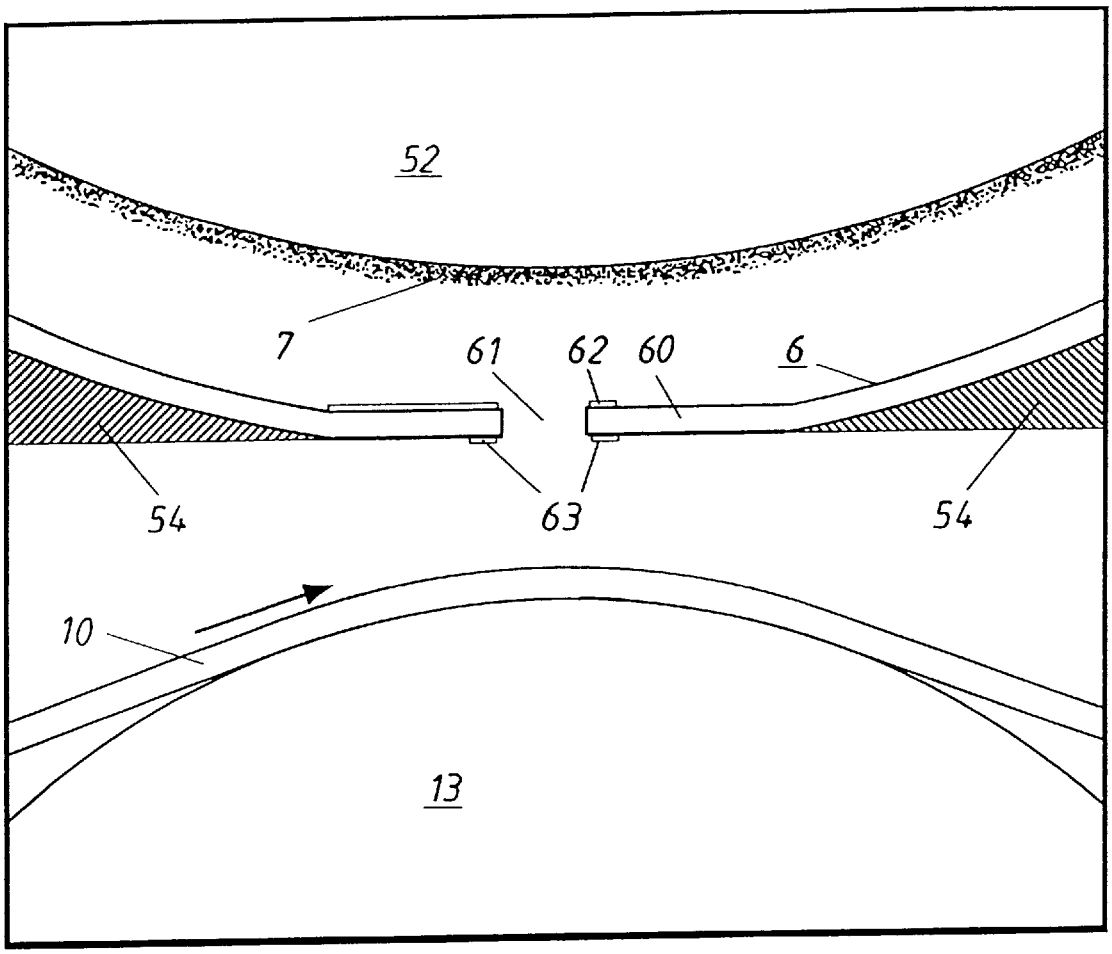
FIG. 3 is an enlargement of FIG. 2 showing the print zone corresponding to a particular print station.

FIG. 3 is an enlargement of the print zone in a print station of, for example, the image printing apparatus shown in FIG. 1. A printhead structure 6 is preferably formed of an electrically insulating substrate layer 60 made of flexible, non-rigid material such as polyamide or the like. The printhead structure 6 is positioned between a peripheral surface of a developer sleeve 52 and a bottom portion of a support device 54. The substrate layer 60 has a top surface facing a toner layer 7 on the peripheral surface of the developer sleeve 52. The substrate layer 60 has a bottom surface facing the bottom portion of the support device 54. Further, the substrate layer 60 has a plurality of apertures 61 arranged through the substrate layer 60 in a part of the substrate layer 60 overlying a elongated slot in the bottom portion of the support device 54. The printhead structure 6 further preferably includes a first printed circuit arranged on the top surface on the substrate layer 60 and a second printed circuit arranged on the bottom surface of the substrate layer 60. The first printed circuit includes a plurality of control electrodes 62, each of which, at least partially, surrounds a corresponding aperture 61 in the substrate layer 60. The second printed circuit preferably includes at least a first and a second set of deflection electrodes 63 spaced around first and second portions of the periphery of the apertures 61 of the substrate layer 60.

The apertures 61 and their surrounding area will under some circumstances need to be cleaned from toner particles which agglomerate there. In some embodiments of the invention the transfer belt 10 advantageously comprises at least one cleaning area for the purpose of cleaning the apertures 61 and the general area of the apertures 61. The cleaning, according to some these embodiments, works by the principle of flowing air (or other gas). A pressure difference, compared to the air pressure in the vicinity of the apertures, is created on the side of the transfer belt 10 that is facing away from the apertures 61. The pressure difference is at least created during part of the time when the cleaning area is in the vicinity of the apertures 61 of the print station in question during the transfer belt's 10 movement. The pressure difference can either be an over pressure, a suction pressure or a sequential combination of both, i.e. the cleaning is performed by either blowing, suction, blowing first then suction, suction first then blowing, or some other sequential combination of suction and blowing. The pressure difference is transferred across the transfer belt 10 by means of the cleaning area comprising at least one slot/hole through the transfer belt 10. The cleaning area preferably comprises at least one row of slots, and more specifically two to eight interlaced rows of slots. The slots can advantageously be in the order of 3 to 5 mm across. The pressure difference appears on the holding element 13 side of the transfer belt 10 through a transfer passage in the holding element 13. The transfer passage can advantageously suitably extend transversally across the printhead structure as an elongated slot with a width, in the direction of the transfer belt 10 movement, that is equal to or greater than the minimum distance between the printhead structure 6 and the transfer belt 10. In some embodiments it can be advantageous to have a controllable passage which can open and close access of the pressure difference to the transfer passage. Thereby a suction pressure will not increase the transfer belt's friction on the holding element 13 more than necessary. The controllable passage will preferably open and close in synchronization with the movement of the transfer belt 10 to thereby coincide its openings with the passage of the cleaning area of the transfer belt 10. The means for creating the pressure difference is also not shown and can suitably be a fan, bellows, a piston, or some other suitable means for creating a pressure difference. In some embodiments according to the invention the transfer passage is substantially located symmetrically in relation to the apertures. In other embodiments according to the invention the transfer passage is shifted in relation to the direction of movement of the transfer belt 10.

Figure 4A:
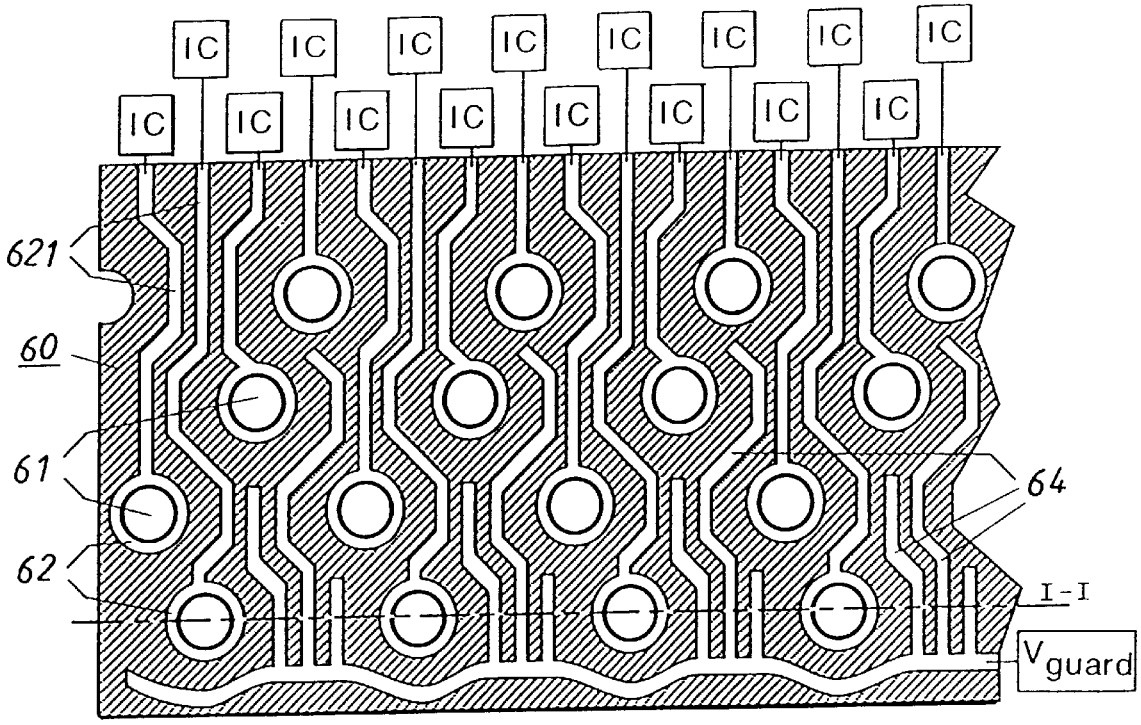
FIG. 4*a* is a schematic plan view of the top side of a printhead structure used in a print station such as that shown in FIG. 2.
Figure 4B:
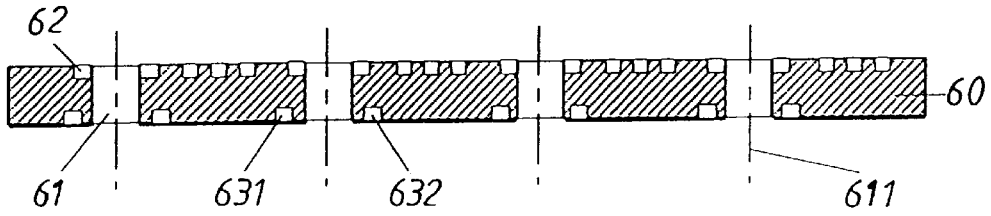
FIG. 4*b* is a schematic section view along the section line I—I through the printhead structure shown in FIG. 4*a,*
Figure 4C:
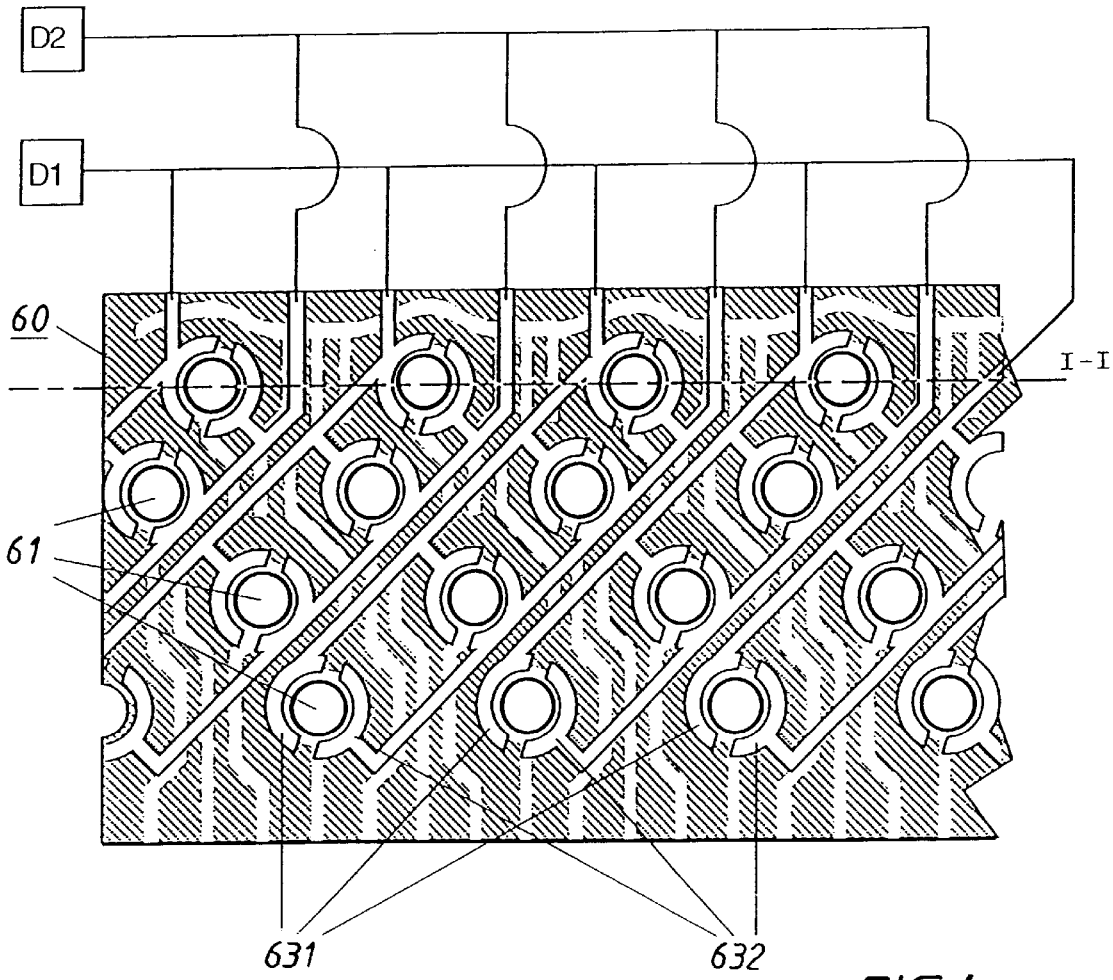
FIG. 4*c* is a schematic plan view of the bottom side of the printhead structure shown in FIG. 4*a,*

Although, a printhead structure 6 can take on various embodiments without departing from the scope of the present invention, a preferred embodiment of the printhead structure will be described hereinafter with reference to FIGS. 4*a*, 4*b* and 4*c*. A plurality of apertures 61 are arranged through the substrate layer 60 in several aperture rows extending transversally across the width of the print zone, preferably at a substantially right angle to the motion of the transfer belt. The apertures 61 can preferably have a circular cross section with a central axis 611 extending perpendicularly to the substrate layer 60 and suitably a diameter in the order of 100 $\mu$m to 160 $\mu$m. Each aperture 61 is surrounded by a control electrode 62 having a part circumscribing the periphery of the aperture 61, with a symmetry axis coinciding with the central axis 611 of the aperture 61 and an inner diameter which is equal or sensibly larger than the aperture diameter. Each control electrode 62 is connected to a control voltage source (IC driver) through a connector 621. As is apparent in FIG. 4*a,* the printhead structure further preferably includes guard electrodes 64, preferably arranged on the top surface of the substrate layer 60 and connected to a guard potential ($V_{guard}$) aimed to, among other things, electrically shield the control electrodes 62 from one another, thereby preventing undesired interaction between the electrostatic fields produced by two adjacent control electrodes 62. Each aperture 61 is related to a first deflection electrode 631 and a second deflection electrode 632 spaced around a first and a second segment of the periphery of the aperture 61, respectively. The deflection electrodes 631, 632 are preferably semicircular or crescent-shaped and disposed symmetrically on each side of a deflection axis extending diametrically across the aperture at a predetermined deflection angle to the motion of the transfer belt, such that the deflection electrodes substantially border on a first and a second half of the circumference of their corresponding aperture 61, respectively. All first and second deflection electrodes 631, 632 are connected to a first and a second deflection voltage source D1, D2, respectively.

Figure 5:
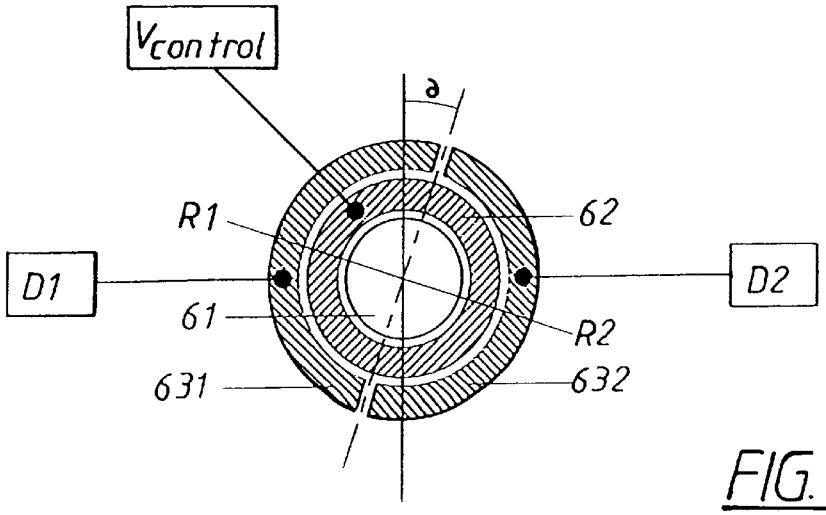
FIG. 5 is a schematic view of a single aperture and its corresponding control electrode and deflection electrodes.

FIG. 5 is a schematic view of a single aperture 61 and its corresponding control electrode 62 and deflection electrodes 631, 632. Toner particles are deflected in a first deflection direction R1 when D1<D2, and an opposite direction R2 when D1>D2. The deflection angle $\delta$ is chosen to compensate for the motion of the transfer belt 10 during the print cycle, in order to be able to obtain two or more transversally aligned dots.

Figure 6A:
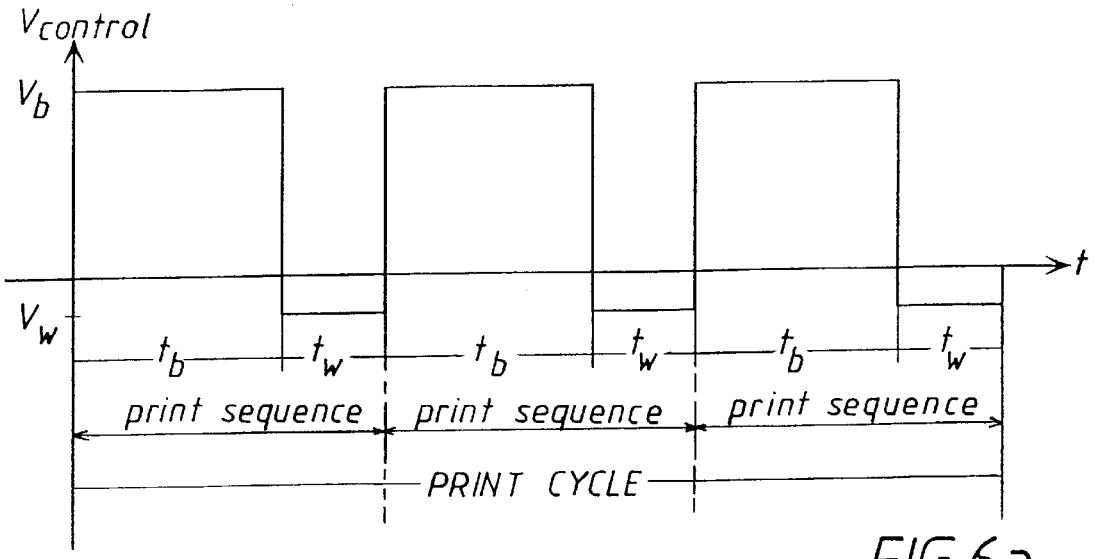
FIG. 6*a* illustrates a control voltage signal as a function of time during a print cycle according to the invention having three subsequent print sequences.

A preferred embodiment according to the invention of a dot deflection control function is illustrated in FIGS. 6*a,* 6*b* and 6*c* respectively showing the control voltage signal ($V_{control}$), a first deflection voltage D1 and a second deflection voltage D2 (not necessarily having the same values during different print sequences during a print cycle), as a function of time during a single print cycle. According to some embodiments of the invention and as illustrated in the figure, printing is performed in print cycles having three subsequent print sequences for addressing three different dot locations through each aperture. In other embodiments each print cycle can suitably have fewer or more addressable dot locations for each aperture. In still further embodiments each print cycle has a controllable number of addressable dot locations for each aperture. During the whole print cycle an electric background field is produced between a first potential on the surface of the developer sleeve and a second potential on the back electrode, to enable the transport of toner particles between the developer sleeve and the information carrier/transfer belt. During a development period which is a part of a print sequence, control voltages are applied to the control electrodes to produce a pattern of electrostatic control fields which due to control in accordance with the image information, selectively open or close the apertures by influencing the electric background field, thereby enhancing or inhibiting the transport of toner through the printhead structure. The toner particles allowed to pass through the opened apertures are then transported toward their intended dot location along a trajectory which is determined by the deflection mode.

The examples of control function shown in FIGS. 6*a,* 6*b* and 6*c* illustrates a control function wherein the toner particles have negative polarity charge. As is apparent from FIG. 6*a,* a print cycle according to the example comprises three print sequences. The length of a print sequence is the length of a print cycle divided by the number of print sequences in a print cycle. Each print sequence comprises a development period $t_b$ followed by a recovering period $t_w$ (not necessarily the same value for each print sequence during a print cycle) during which, among other things, new toner is supplied to the print zone. The control voltage pulse ($V_{control}$) can be amplitude and/or pulse width modulated, to allow the intended/desired amount of toner particles to be transported through the aperture. For instance, the amplitude of the control voltage varies between a non-print level $V_w$ of approximately −50V and a print level $V_b$ in the order of +350V, corresponding to full density dots. Similarly, the pulse width can be varied from 0 to $t_b$. In the example all three print sequences have development periods with a maximum pulse width $t_b$. A critical time is the time it takes the toner particles to reach their intended dot location, i.e. in the prior art the last toner particles that are released have to be able to reach their intended dot location during the recovery period $t_w$ before a new print sequence with new deflection voltages starts.

Figure 6B:
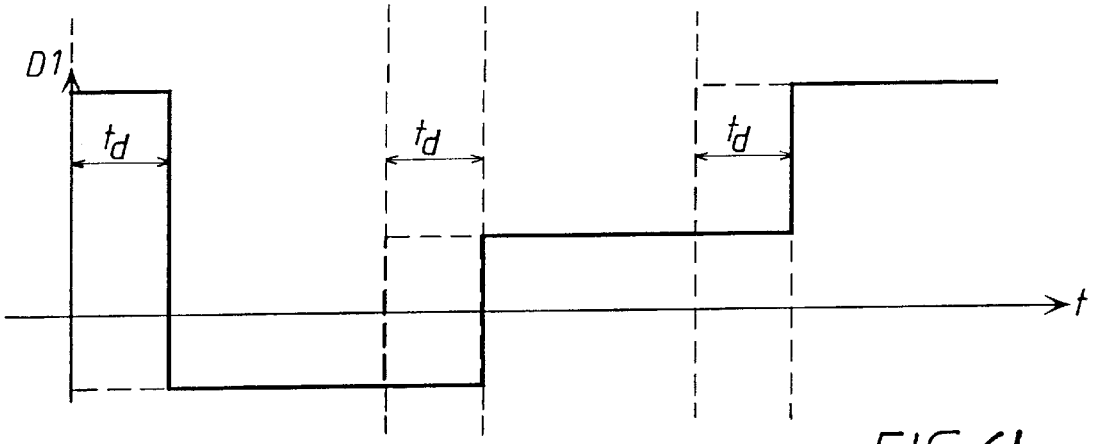
FIG. 6*b* illustrates a first deflection voltage signal according to the invention as a function of time during a print cycle having three subsequent print sequences.
Figure 6C:
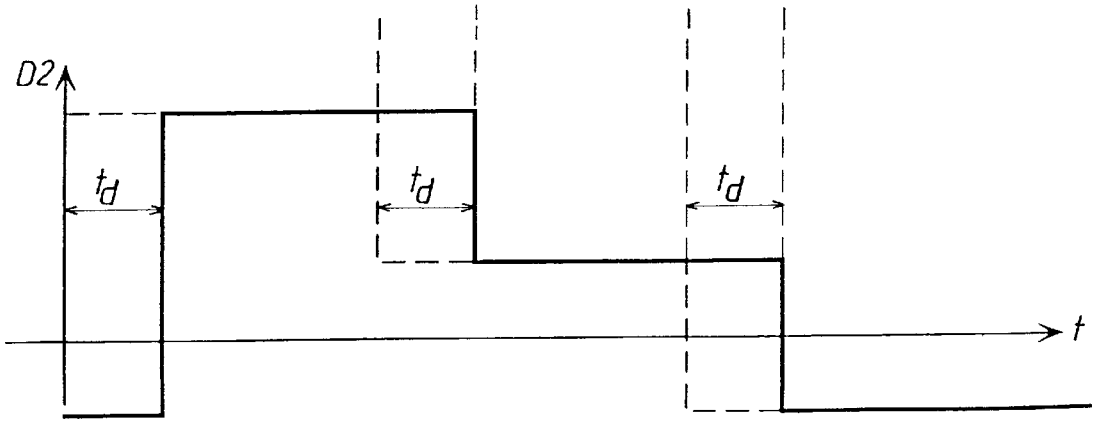
FIG. 6*c* illustrates a second deflection voltage signal according to the invention as a function of time during a print cycle having three subsequent print sequences.

As apparent from FIGS. 6*b* and 6*c,* the amplitude difference between D1 and D2 is sequentially modified for providing three different toner trajectories, i.e. dot positions, during each print cycle. The amplitudes of D1 and D2 are modulated to apply converging forces on the toner to obtain smaller dots. Utilizing this method enables, for example, 60 $\mu$m dots to be obtained utilizing 160 $\mu$m apertures. Suitably the size of the dots are adjusted in accordance with the dot density (dpi) and thus also dynamically with the number of dot locations each aperture is to address.

A desire to increase the printing speed can, if taken to far, cause the last toner particles not to reach their intended dot location before the end of the current print sequence. That is, the recovery period $t_w$ with the current deflection voltages is to short for the last toner particles to reach their intended dot locations before the deflection voltages change. If there are still toner particles that have not reached their intended dot location at the end of a print sequence, then a changeover of the deflection voltages D1 and D2 to the voltage levels of the new print sequence will cause the toner particles which have not reached their intended dot location to deflect in a direction away from their intended dot location on an image receiving member (for example a transfer belt or an information carrier such as paper). This will typically result in a round dot with a tail which is usually called dot tailing, i.e. there will be a print quality degradation. This will normally put a restriction on the minimum time a print sequence can possibly be, without any print quality degradation, and thus also a restriction on the maximum print speed. However according to the invention the print sequence can be decreased further without causing a degradation in print quality. According to the invention the deflection voltages D1 and D2 are time displaced $t_d$ in relation to the start of their corresponding print sequence. Or rather, the deflection voltages D1 and D2 of the previous print sequence are kept for a time $t_d$ into the current print sequence. The time displacement $t_d$ can be in the order of time that it takes for toner particles of the current print sequence to travel from the toner particle source and to reach the apertures, pass halfway through the apertures or just pass through the apertures.

This will cause a partial overlap of print sequences. By partially overlapping the print sequences according to the invention the length of the print sequences may in view of dot tailing be decreased to allow an increase in printing speed without any further degradation in print quality, due to that the resulting effective time (i.e. from the apertures to reaching an intended dot location) that the toner particles are subjected to a deflection voltage is kept the same, i.e. the toner particles are allowed to reach their intended dot location before a change of deflection voltages occurs. In a preferred embodiment the change over of deflection voltages can even occur just before the very last toner particles of the previous print sequence reach their intended dot location. This is possible since the last toner particles have a very high speed and the influence of the deflection electrodes and thus deflection voltages decrease the further from the deflection electrodes the toner particles are. Thus a change in deflection voltages when the toner particles are close to their intended dot location will not cause the toner particles to deflect unduly from their initial trajectory, and suitably the last toner particles will still end up within the intended dot location which has a certain extension. This time that the changeover of deflection voltages can occur before the very last toner particles reach their intended dot location can suitably be in the region of when the very last toner particles are from 0 to 50 $\mu$m from their intended dot location, which can also suitably differ between print sequences depending on the size of the trajectory difference (i.e. difference in deflection voltages) between two consecutive print sequences. This will enable an even higher print speed.

According to the invention a partial overlap of consecutive print sequences is possible by delaying by a value $t_d$ the changeover of deflection voltages D1 and D2 from the values of the previous print sequence to the values of the current print sequence, i.e. the toner particles from the previous print sequence are deflected by the values of the previous print sequence for the delay time $t_d$ into the current print sequence. The delay times does not necessarily have to be the same for all of the print sequences, in some embodiments for a completely optimized print cycle the delay times will differ between the different print sequences. This partial overlap which results in toner particles from the previous and current print sequences being transported at the same time is possible because the toner particles of the current print sequence do not need to be deflected immediately. The delay time can due to this preferably be in the order of magnitude the time that it takes for toner particles to be transported from the toner particle source to the apertures to from the toner particle source to just through the apertures, which in current embodiments is in the region of 0.1 $\mu$S to 100 $\mu$S and preferably in the region of 10 $\mu$S to 50 $\mu$S.

Due to this overlap there is a saving of time, during each print cycle, of all the delay times $t_d$ of the print sequences during a print cycle. This will thus enable an increased print speed without a degradation in print quality.

Figure 7A:
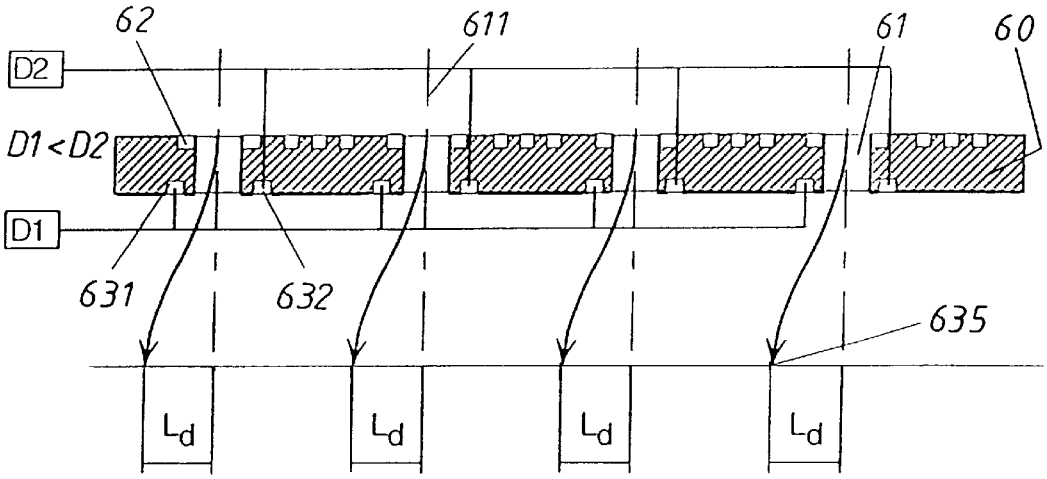
FIG. 7*a* illustrates the transport trajectory of toner particles through the printhead structure shown in FIGS. 4*a,b,c* according to a first deflection mode wherein D1<D2.
Figure 7B:
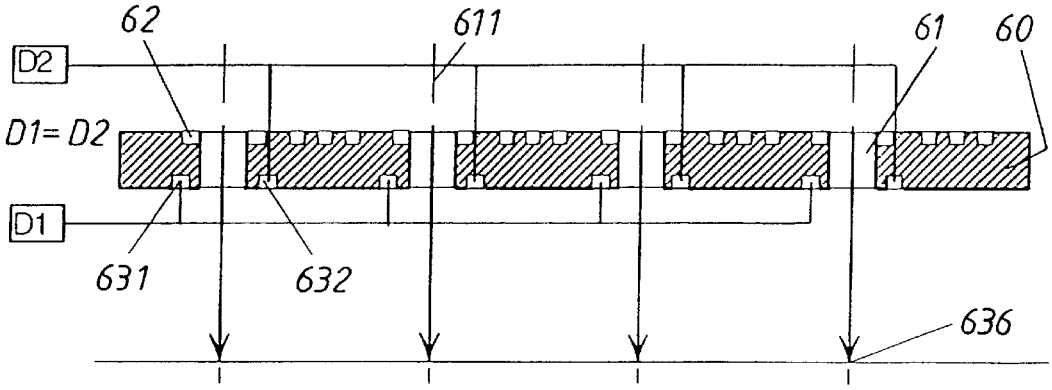
FIG. 7*b* illustrates the transport trajectory of toner particles through the printhead structure shown in FIGS. 4*a,b,c,* according to a second deflection mode wherein D1=D2.
Figure 7C:
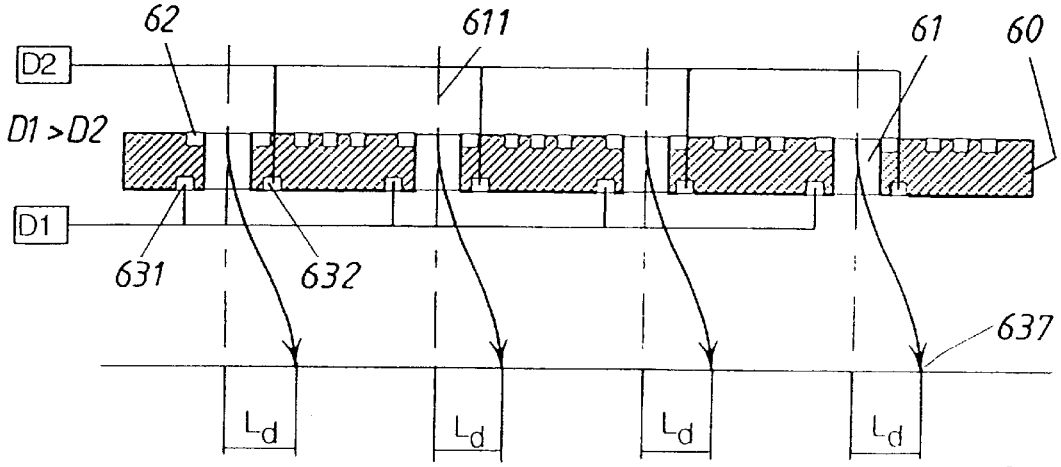
FIG. 7*c* illustrates the transport trajectory of toner particles through the printhead structure shown in FIGS. 4*a,b,c,* according to a third deflection mode wherein D1>D2.

FIGS. 7*a,* 7*b* and 7*c* illustrate the toner trajectories in three subsequent deflection modes. The FIGS. 7*a,* 7*b* and 7*c* illustrate a cross section of a substrate layer 60 with apertures 61 with corresponding control electrodes 62. Also illustrated are deflection voltages D1 and D2 that are connected to respective deflection electrodes 631, 632. During a first print sequence illustrated in FIG. 7*a,* the modulated stream of toner particles is deflected to the left by producing a first amplitude difference (D1<D2) between both deflection voltages. The amplitude difference is adjusted to address dot locations 635 located at a deflection length $L_d$ to the left of the central axes 611 of the apertures 61. During a second print sequence illustrated in FIG. 7*b,* the deflection voltages have equal amplitudes (D1=D2) to address undeflected dot locations 636 coinciding with the central axes 611 of the apertures 61. During a third print sequence illustrated in FIG. 9*c,* the modulated stream of toner particles is deflected to the right by producing a second amplitude difference (D1>D2) between both deflection voltages. The amplitude difference is adjusted to address dot locations 637 located at a deflection length $L_d$ to the right of the central axes 611 of the apertures 61.

The invention is not limited to the embodiments described above but may be varied within the scope of the appended patent claims.

What is claimed is:

1. A direct electrostatic printing device comprising:

a pigment particle source, which provides pigment particles;

a voltage source;

a control unit;

at least one printhead structure having a plurality of apertures through the printhead structure and having control electrodes proximate to the apertures, the control electrodes being coupled to the control unit;

a back electrode; and an image receiving member, wherein:

the image receiving member and the at least one printhead structure move relative to each other during printing, resulting in a relative movement of the at least one printhead structure and the image receiving member;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles during print sequences, a predetermined number of which print sequences are included in a print cycle, to thereby enable the formation of a pigment image on the first face of the image receiving member; and the at least one printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed.

2. A direct electrostatic printing device according to claim 1, wherein the time displacement of the change of the predetermined deflection voltages of the previous print sequence to the predetermined deflection voltages of the current print sequence is a time delay greater than zero.

3. A direct electrostatic printing device according to claim 1, wherein the change of the predetermined deflection voltages of the previous print sequence to the predetermined deflection voltages of the current print sequence is time displaced relative to a beginning of the current print sequence in such a way that the change of the predetermined deflection voltages does not occur within a possible time for opening an aperture during the current print sequence.

4. A direct electrostatic printing device according to claim 1, wherein the image printing device comprises an image receiving member position measuring means for measuring a position of the image receiving member in relation to the apertures to thereby via the control unit be able to synchronize the selective opening and closing of the apertures through the at least one printhead structure according to the relative movement of the at least one printhead structure and the image receiving member to thereby enable formation of a pigment image at a predetermined position on the image receiving member in view of an image which is to be printed.

5. A direct electrostatic printing device according to claim 4, wherein the image printing device includes at least two pigment particle sources with respective corresponding control electrodes and respective apertures on the at least one printhead structure, whereby the image receiving member position measuring means measures the position of the image receiving member in relation to the respective apertures to thereby via the control unit be able to synchronize the selective opening and closing of the respective apertures through the at least one printhead structure according to the relative movement of the at least one printhead structure and the image receiving member to thereby enable the formation of a respective pigment image at a predetermined position on the image receiving member in view of the image which is to be printed.

6. A direct electrostatic printing device according to claim 5, wherein the image printing device is capable of printing color images and includes four pigment particle sources.

7. A direct electrostatic printing device according to claim 1, wherein the image receiving member is an information carrier.

8. A direct electrostatic printing device according to claim 1, wherein the image receiving member is an intermediate image receiving member and includes a transfer belt positioned at a predetermined distance from the at least one printhead structure, the transfer belt being substantially of uniform thickness, whereby the pigment image is subsequently transferred to an information carrier.

9. A direct electrostatic printing device according to claim 8, wherein the transfer belt is supported by at least one holding element arranged on a side of the second face of the transfer belt adjacent to the at least one printhead structure.

10. A direct electrostatic printing device according to claim 8, wherein the first face of the intermediate image receiving member is substantially evenly coated with a layer of bouncing reduction agent thus providing a surface on the first face of the intermediate image receiving member that the pigment particles transported through the at least one printhead structure substantially adhere to substantially without bouncing.

11. A direct electrostatic printing device according to claim 10, wherein the bouncing reduction agent is a liquid having adhesion properties suitable for the adhesion of pigment particles to the first face of the intermediate image receiving member and wherein the image printing device further comprises a film application means for applying the bouncing reduction agent liquid substantially evenly as a film layer onto the first face of the intermediate image receiving member.

12. A direct electrostatic printing device according to claim 11, wherein the bouncing reduction agent is a silicone oil having appropriate adhesion properties for reducing bouncing of pigment particles when pigment particles are transferred onto the first face of the intermediate image receiving member and also having appropriate release properties when a pigment image is transferred to an information carrier from the intermediate image receiving member.

13. A direct electrostatic printing device according to claim 8, wherein the image printing device further comprises a transfuser having heating means and pressurizing means for transferring a pigment image on a surface of the first face of the intermediate image receiving member to an information carrier by locally applying heat and pressure to the information carrier and the pigment image by the heating means and pressurizing means and thereby transferring the pigment image to the information carrier.

14. A direct electrostatic printing device according to claim 8, wherein the image printing device comprises a pressure changing means which can create a pressure difference on a side of the second face of the intermediate image receiving member in the vicinity of the apertures of the at least one printhead structure, and where the intermediate image receiving member comprises a cleaning area for cleaning purposes and a separate image area intended for reception of pigment particles for formation of a pigment image thereon, where the cleaning area includes at least one slot between the first face and the second face intended for transmitting the pressure difference through the intermediate image receiving member to thereby, in cooperation with the pressure changing means in the vicinity of the apertures of the at least one printhead structure, dislodge pigment agglomeration for cleaning the apertures of the at least one printhead structure.

15. A direct electrostatic printing device according to claim 1, wherein the printing device includes at least two pigment particle sources with corresponding control electrodes and apertures on and in the at least one printhead structure.

16. A direct electrostatic printing device according to claim 1, wherein the image printing device includes four pigment particle sources with corresponding control electrodes and apertures on and in at the least one printhead structure.

17. A direct electrostatic printing device according to claim 1, wherein the image printing device further comprises deflection control feedback means for providing a deflection feedback signal to the control unit to thereby control the deflection electrodes in such a way that pigment particles are, for formation of a pigment image on the intermediate image receiving member in view of the image which is to be printed, trajected toward predetermined locations on the intermediate image receiving member.

18. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member, wherein:

the image receiving member and the printhead structure move relative to each other during printing, resulting in a relative movement of the printhead structure and the image receiving member;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles during print sequences, a predetermined number of which print sequences are included in a print cycle, to thereby enable the formation of a pigment image on the first face of the image receiving member;

the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed; and the time displacement is less than a time of transport of a pigment particle from the pigment particle source to the printhead structure.

19. A direct electrostatic printing device comprising:

a pigment particle source which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member, wherein:

the image receiving member and the printhead structure move relative to each other during printing, resulting in a relative movement of the printhead structure and the image receiving member;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles during print sequences, a predetermined number of which print sequences are included in a print cycle, to thereby enable the formation of a pigment image on the first face of the image receiving member;

the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed; and the time displacement is in an order of magnitude of a time of transport of a pigment particle from the pigment particle source to the printhead structure.

20. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member, wherein:

the image receiving member and the printhead structure move relative to each other during printing, resulting in a relative movement of the printhead structure and the image receiving member;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles during print sequences, a predetermined number of which print sequences are included in a print cycle, to thereby enable the formation of a pigment image on the first face of the image receiving member;

the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed; and the time displacement is in an order of magnitude of a time of transport of a pigment particle from the pigment particle source to halfway through an aperture.

21. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member, wherein:

the image receiving member and the printhead structure move relative to each other during printing, resulting in a relative movement of the printhead structure and the image receiving member;

the image receiving member has a first face and a second face;

the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles during print sequences, a predetermined number of which print sequences are included in a print cycle, to thereby enable the formation of a pigment image on the first face of the image receiving member;

the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed; and the time displacement is in an order of magnitude of a time of transport of a pigment particle from the pigment particle source to just through an aperture.

22. A direct electrostatic printing device comprising:

a pigment particle source, which provides pigment particles;

a voltage source;

a control unit;

a printhead structure having a plurality of apertures through the printhead structure and having control electrodes proximate to the apertures, the control electrodes being coupled to the control unit;

a back electrode; and an image receiving member, wherein:

the image receiving member and the printhead structure move relative to each other during printing, resulting in a relative movement of the printhead structure and the image receiving member;

the image receiving member has a first face and a second face; the printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the printhead structure are responsive to the control unit to thereby selectively open or close the apertures through the printhead structure to permit or restrict the transport of pigment particles during print sequences, a predetermined number of which print sequences are included in a print cycle, to thereby enable the formation of a pigment image on the first face of the image receiving member;

the printhead structure includes deflection electrodes connected to the control unit for controlling the deflection of pigment particles in transport to thereby be able to deflect pigment particles against predetermined locations on the first face of the image receiving member in view of the image which is to be printed by means of predetermined deflection voltages related to each one of the predetermined number of print sequences, where a change of the predetermined deflection voltages of a previous print sequence to the predetermined deflection voltages of a current print sequence is time displaced relative to the beginning of the current print sequence, to thereby enable a faster print speed; and the time displacement is between approximately 0.1 $\mu$s to 100 $\mu$s.

23. A direct electrostatic printing device according to claim 22, wherein the time displacement is between approximately 10 $\mu$s to 50 $\mu$s.

24. A method for printing an image to an information carrier, wherein the method comprises the following steps:

providing pigment particles from a pigment particle source;

moving an image receiving member and a printhead structure relative to each other during printing;

creating an electrical field for transporting of pigment particles from the pigment particle source toward a first face of the image receiving member via the printhead structure;

selectively opening or closing apertures through the printhead structure to permit or restrict the transporting of pigment particles to thereby enable formation of a pigment image on the first face of the image receiving member during a print sequence, a predetermined number of which print sequences are included in a print cycle;

controlling the deflection of pigment particles in transport to thereby be able to deflect pigment particles against predetermined locations on the first face of the image receiving member in view of the image which is to be printed by means of predetermined deflection voltages related to each one of the predetermined number of print sequences; and time displacing, relative to the beginning of the current print sequence, a change of the predetermined deflection voltages of a previous print sequence to the predetermined deflection voltages of a current print sequence, to thereby enable a faster print speed.

* * * * *